US009502816B2

(12) United States Patent
Hashimoto et al.

(10) Patent No.: US 9,502,816 B2
(45) Date of Patent: Nov. 22, 2016

(54) CONNECTOR TERMINAL

(71) Applicant: DAI-ICHI SEIKO CO., LTD., Kyoto (JP)

(72) Inventors: Yoshimitsu Hashimoto, Fukuoka (JP); Shunya Oohashi, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/521,260

(22) Filed: Oct. 22, 2014

(65) Prior Publication Data

US 2015/0111437 A1 Apr. 23, 2015

(30) Foreign Application Priority Data

Oct. 23, 2013 (JP) ..... 2013-220332

(51) Int. Cl.

| | |
|---|---|
| ***H01R 11/22*** | (2006.01) |
| ***H01R 13/62*** | (2006.01) |
| ***H01R 24/66*** | (2011.01) |
| ***H01R 13/41*** | (2006.01) |

(52) U.S. Cl.
CPC ..... *H01R 13/62* (2013.01); *H01R 13/41* (2013.01); *H01R 24/66* (2013.01)

(58) Field of Classification Search
CPC ..... H01R 13/115; H01R 13/113
USPC ..... 439/849, 852, 850, 854, 862, 876
See application file for complete search history.

(56) References Cited

U.S. PATENT DOCUMENTS

| | | | | |
|---|---|---|---|---|
| 4,082,402 A * | 4/1978 | Kinkaid | ..... | H01R 4/2495 439/422 |
| 2011/0070752 A1* | 3/2011 | Yamashiro | ..... | H01R 12/57 439/83 |

FOREIGN PATENT DOCUMENTS

| | | | | |
|---|---|---|---|---|
| DE | 6928281 | 12/1969 | | |
| DE | 39 14 872 | 11/1990 | ..... | H01R 13/40 |
| JP | H01-88472 | 6/1989 | ..... | H01R 13/40 |
| JP | H0414865 | 4/1992 | ..... | H01R 13/40 |
| JP | H0613064 | 2/1994 | ..... | H01R 13/41 |
| JP | 10154542 | 6/1998 | ..... | H01R 13/40 |
| JP | 2004311044 | 11/2004 | ..... | H01R 13/41 |
| JP | 2005259503 | 9/2005 | ..... | H01R 12/32 |
| JP | 2008-243745 | 10/2008 | ..... | H01R 13/41 |

OTHER PUBLICATIONS

Preliminary Search Report issued in corresponding French Patent Appln. No. 1459970 dated Mar. 11, 2016, with English translation of Written Opinion (9 pgs).

* cited by examiner

*Primary Examiner* — Phuongchi T Nguyen
(74) *Attorney, Agent, or Firm* — Hayes Soloway P.C.

(57) ABSTRACT

An connector terminal to be inserted into an opening of a housing, includes a first portion inserted into the opening such that the first portion is held in the opening, and a second portion outwardly projecting from the first portion, the second portion being formed at a surface thereof with at least one groove extending perpendicularly to a direction in which the connector terminal is inserted into the opening.

6 Claims, 16 Drawing Sheets

CONNECTOR TERMINAL

BACKGROUND OF THE INVENTION

Field of the Invention

The invention relates to a connector terminal as a part of an electric connector used for electrically connecting various devices equipped in an automobile to each other.

Description of the Related Art

In general, an electric connector includes a housing made of electrically insulating resin, and a plurality of male connector terminals made of metal. The male connector terminals are inserted into and kept in openings formed at the housing. The male connector terminals are inserted into female connector terminals of another electric terminal to thereby electrically connect the electric terminals to each other.

In order to reduce a force with which a male connector terminal is inserted into a female connector terminal, there has been suggested to use a plating capable of reducing the above-mentioned force.

FIG. 15 is a cross-sectional view of the contact suggested in Japanese Utility Model Application Publication No. H6 (1994)-13064.

The illustrated contact 72 is a part of a plug connector 70. The contact 72 includes a first portion 72*c* making contact with a receptacle contact, and a second portion 72*b* through which the contact 72 is soldered to another part. The first and second portions 72*b* and 72*c* are L-shaped. The first portion 72*c* is formed at a lower portion thereof with a raised portion 72*d*. A plug housing 71 centrally includes a central partition wall 71*a*, and is formed at opposite sides of the central partition wall 71*a* with holes 71*b* and grooves 71*c*. Each of the grooves 71*c* is continuous with each of the holes 71*b*. The first portion 72*c* of the contact 72 is inserted into the hole 71*b* and the groove 71*c*. Since the raised portion 72*d* projects in a direction perpendicular to a direction in which the contacts 72 are arranged in a line, it is possible to avoid distortion caused in the housing 71 by the raised portion 72 from being concentrated in the direction in which the contacts 72 are arranged, ensuring that the housing 71 is not deformed, and the contact 72 can be surely soldered to another part through the second portion 72*b*.

FIG. 16 is a perspective view of the contact suggested in Japanese Utility Model Publication No. H4 (1992)-14865.

As illustrated in FIG. 16, a body 81 made of an electrically insulative material containing glass fibers therein is formed a plurality of holes 82, into each of which a contact 83 in the form of a plate is inserted. The contact 83 is formed at a surface facing an inner surface of the hole 82 with an area 81 in which grooves are formed. The grooves extend in a direction perpendicular to a direction 85 in which the contact 83 is inserted into the hole 82. Inserting the contact 83 into the hole 82, raised portions in the area 81 are ground by the glass fibers. Since only the raised portions in the area 81 are ground, there are not generated long metal burrs, and hence, it is possible to prevent generation of metal burrs when the contact 83 is inserted into the hole 82.

FIG. 17 is a perspective view of the connector terminal suggested in Japanese Patent Application Publication No. 2004-311044.

The illustrated connector terminal 90 is fabricated by pressing a flat metal plate, and includes a tab 91 to be inserted into a terminal of another connector, a base 92 continuous at one end thereof to the tab 91, and a pair of projections 93 extending from the other end of the base 92. The base 92 is defined by two pairs of outer surfaces 92*a*, 92*c* and 92*b*, 92*d* each facing each other. Two rectangular engagement pieces 91*a* and 91*c* are formed on the outer surfaces (upper and lower surfaces) 92*a* and 92*c* by partially cutting the base 92. The engagement piece 91*a* upwardly obliquely projects, and the engagement piece 91*c* downwardly obliquely projects. When the connector terminal 90 is inserted into an opening of a connector housing, the engagement pieces 91*a* and 91*c* are engaged with projections formed in the connector housing to thereby prevent the connector terminal 90 from being released out of the connector housing, ensuring that the connector terminal 90 can be surely kept to be held in the connector housing.

In the case that a male connector terminal is plated with such a metal that a force with which the male connector terminal is inserted into a female connector terminal of another electric connector can be reduced, there is caused a problem that a force with which a housing of an electric connector holds the male connector terminal may be reduced. In contrast, if the latter mentioned force is increased, there is caused a problem that an accuracy with which the male connector terminal is situated relative to a connector housing may be reduced.

In order to solve the above-mentioned problems, various solutions have been suggested. However, it is necessary to separately prepare a structure for increasing a force with which a housing of an electric connector holds a male connector terminal, and a structure for increasing an accuracy with which a male connector terminal is situated relative to a connector housing. In dependence on a terminal size, these two structures cannot be added to each other. Thus, presently the above-mentioned force and the above-mentioned accuracy cannot be concurrently provided to a connector terminal.

Though the conventional terminals illustrated in FIGS. 15 to 17 relate to a structure for inserting a connector terminal into an opening of a connector housing, similarly to the later-mentioned present invention, these conventional terminals cannot concurrently have the above-mentioned force and the above-mentioned accuracy.

SUMMARY OF THE INVENTION

In view of the above-mentioned problems in the conventional terminals, it is an object of the present invention to provide a connector terminal capable of concurrently having the above-mentioned force and the above-mentioned accuracy.

In one aspect of the present invention, there is provided a connector terminal to be inserted into an opening of a housing, including a first portion inserted into the opening such that the first portion is held in the opening, and a second portion outwardly projecting from the first portion, the second portion being formed at a surface thereof with at least one groove extending perpendicularly to a direction in which the connector terminal is inserted into the opening.

When the first portion of the connector terminal is inserted into an opening of a connector housing, the second portion outwardly projecting from the first portion makes abutment with an inner surface of the opening to thereby increase an accuracy with which a male connector terminal is situated relative to a connector housing. Furthermore, electrically insulating resin of which an inner surface of the opening is made thrusts into the groove formed on a surface of the second portion, by virtue of a frictional force generated between the first portion and the opening when the first portion of the connector terminal is inserted into the opening, ensuring that a force with which a connector housing holds a male connector terminal can be increased.

It is preferable that the groove is V-shaped.

The V-shaped groove can make the above-mentioned force intensive.

In the case that the groove is V-shaped, it is preferable that the V-shaped groove is defined with a first inclined surface and a second inclined surface located ahead of the first inclined surface in the direction, the first inclined surface having an inclination angle smaller than the same of the second inclined surface, the inclination angle being defined as an angle formed between the first or second inclined surface and a surface of the first portion.

By so designing the V-shaped groove, it is possible to prevent a force with which the first portion of the connector terminal is inserted into the opening, from increasing, and further, to increase a force with which a connector housing holds a male connector terminal can be increased.

It is preferable that the second portion is formed at a surface thereof with a plurality of grooves extending perpendicularly to the direction, the grooves being arranged in the direction.

Electrically insulating resin of which an inner surface of the opening is made thrusts into the grooves, and thus, the connector terminal is firmly kept in the opening, ensuring that a force with which a connector housing holds a male connector terminal can be increased.

It is preferable that the second portion is formed at an entire surface thereof with the grooves.

An area in which the grooves are formed on a surface of the second portion is maximized, ensuring that a force with which a connector housing holds a male connector terminal can be increased.

The advantages obtained by the aforementioned present invention will be described hereinbelow.

The connector terminal in accordance with the present invention is capable of providing enhancement in both a force with which a connector housing holds a male connector terminal and an accuracy with which a male connector terminal is situated relative to a connector housing.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

The connector terminal 10 in accordance with the preferred embodiment of the present invention is explained hereinbelow with FIGS. 1 to 14.

An electric connector 100 includes a plurality of the connector terminals 10, and a housing (see FIGS. 6 and 7) 50 made of electrically insulative resin.

Figure 6:
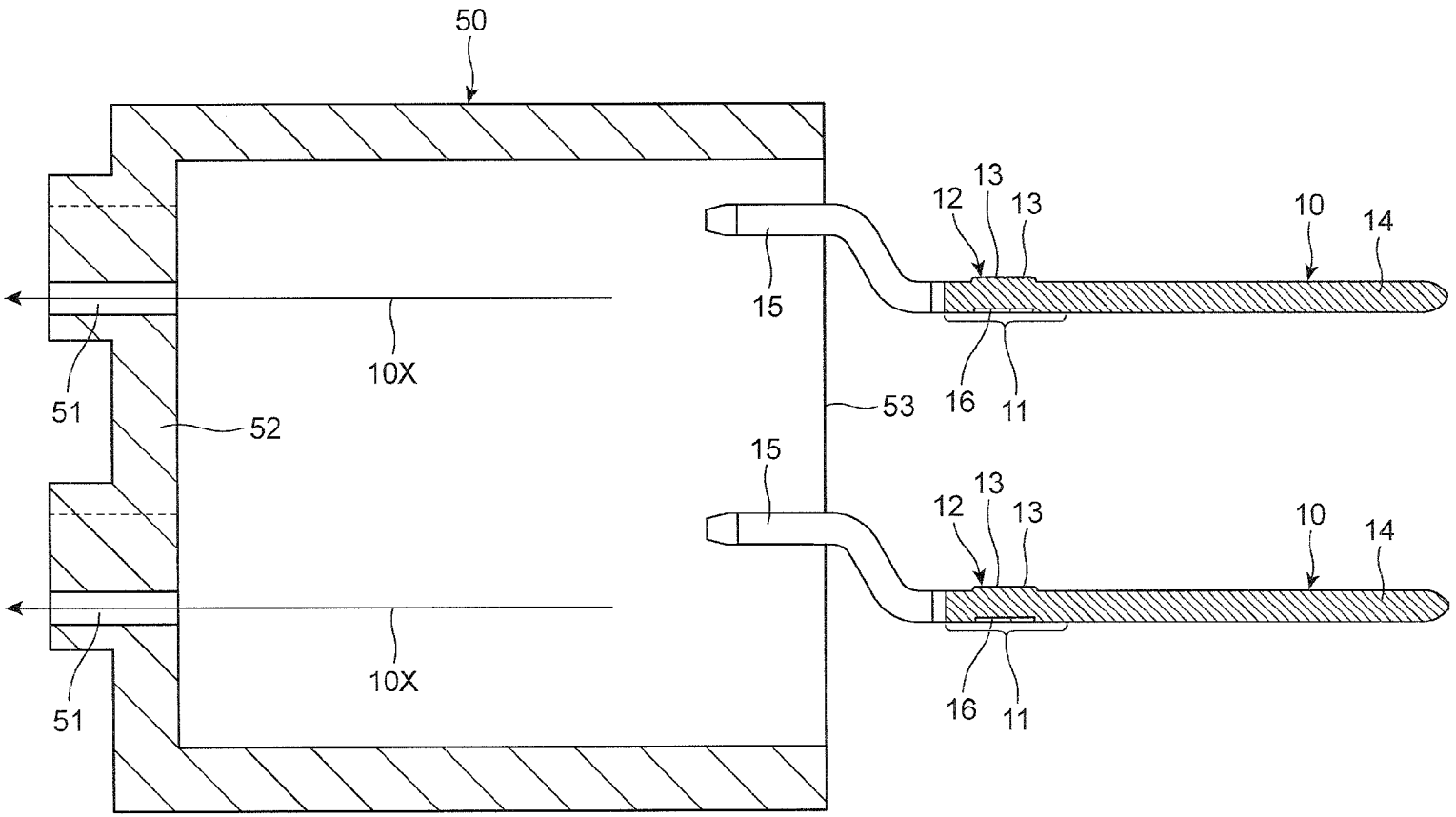
FIG. 6 is a cross-sectional view of the connector terminal illustrated in FIG. 1, and a housing into which the connector terminal is inserted.
Figure 7:
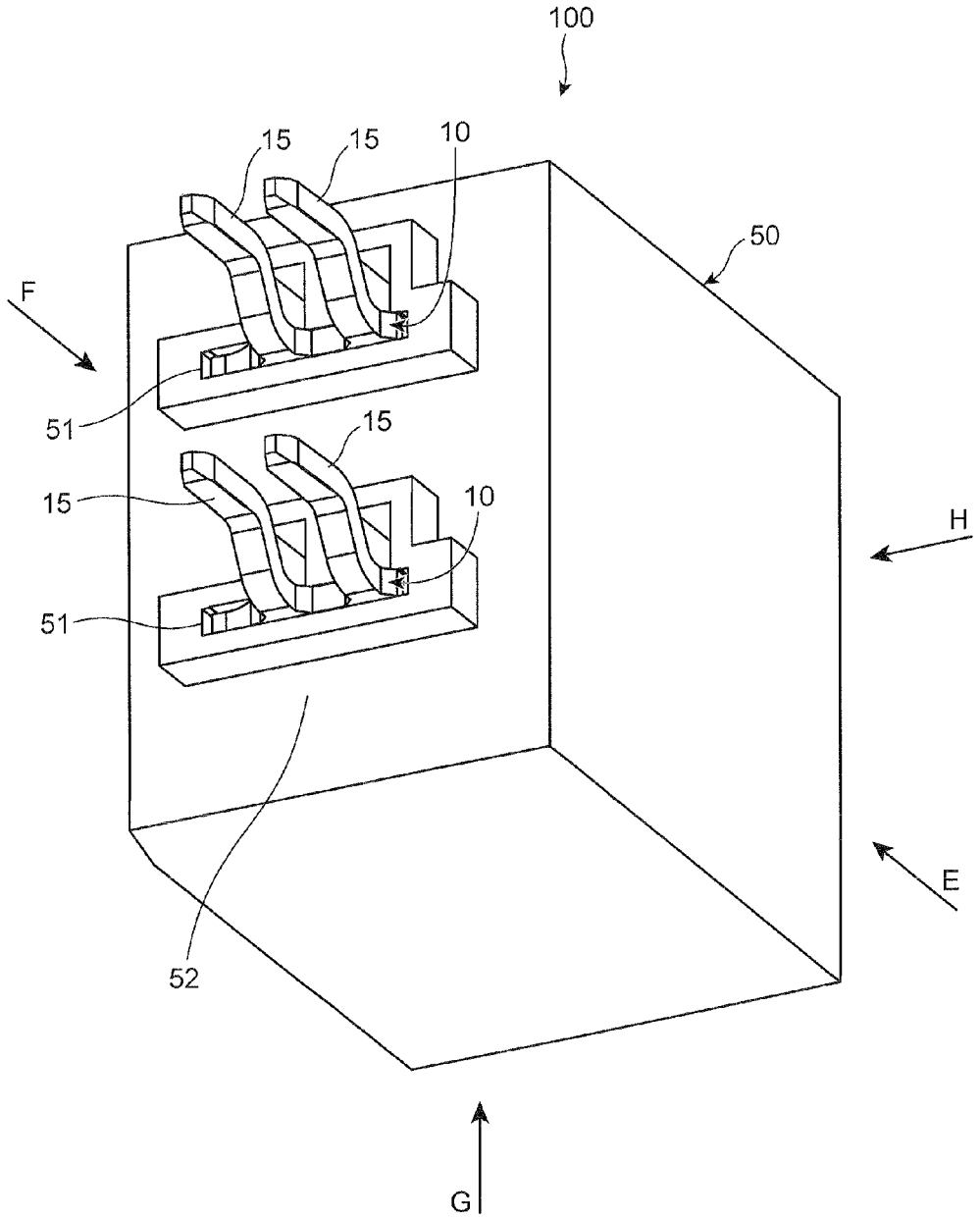
FIG. 7 is a rear perspective view of the electric connector including the connector terminal illustrated in FIG. 1.
Figure 8:
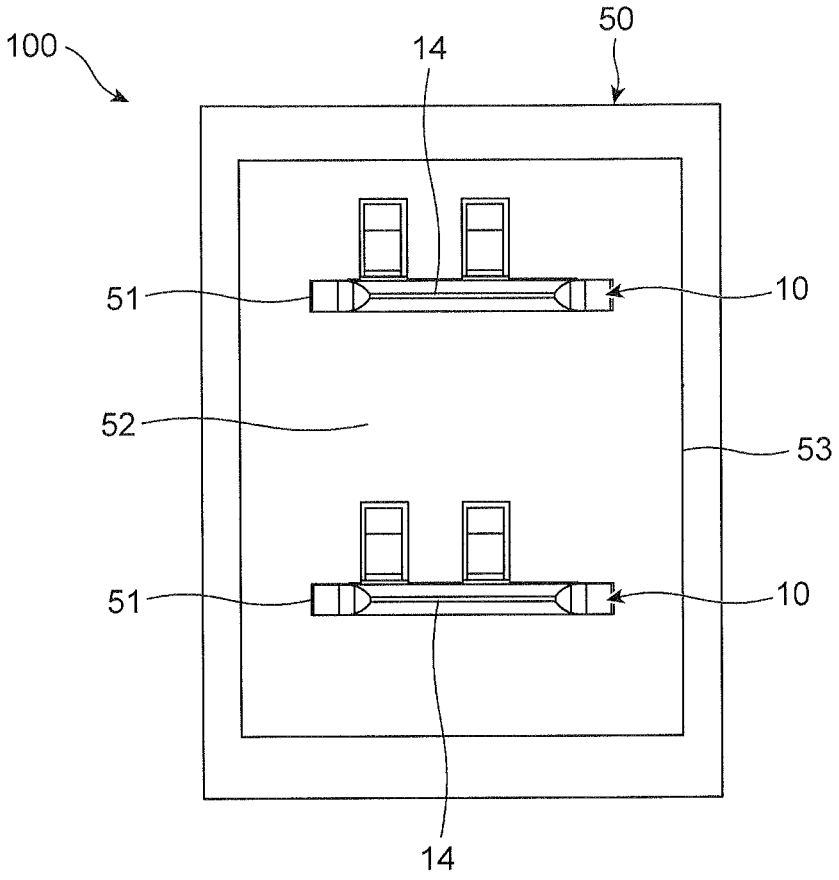
FIG. 8 is a front view of the electric connector, viewed in a direction of an arrow E shown in FIG. 7.
Figure 9:
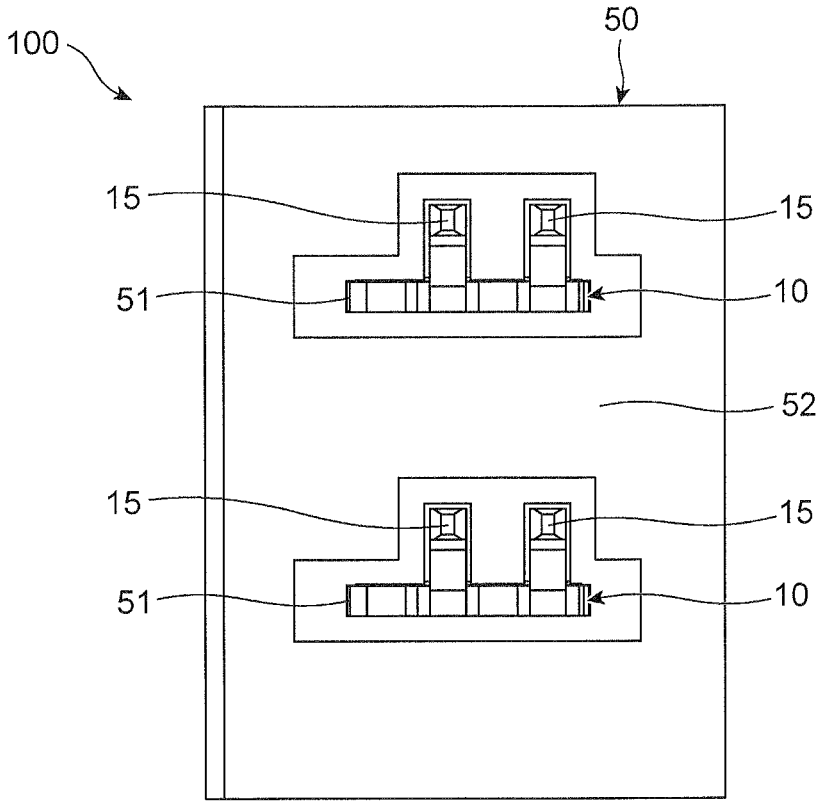
FIG. 9 is a rear view of the electric connector, viewed in a direction of an arrow F shown in FIG. 7.
Figure 10:
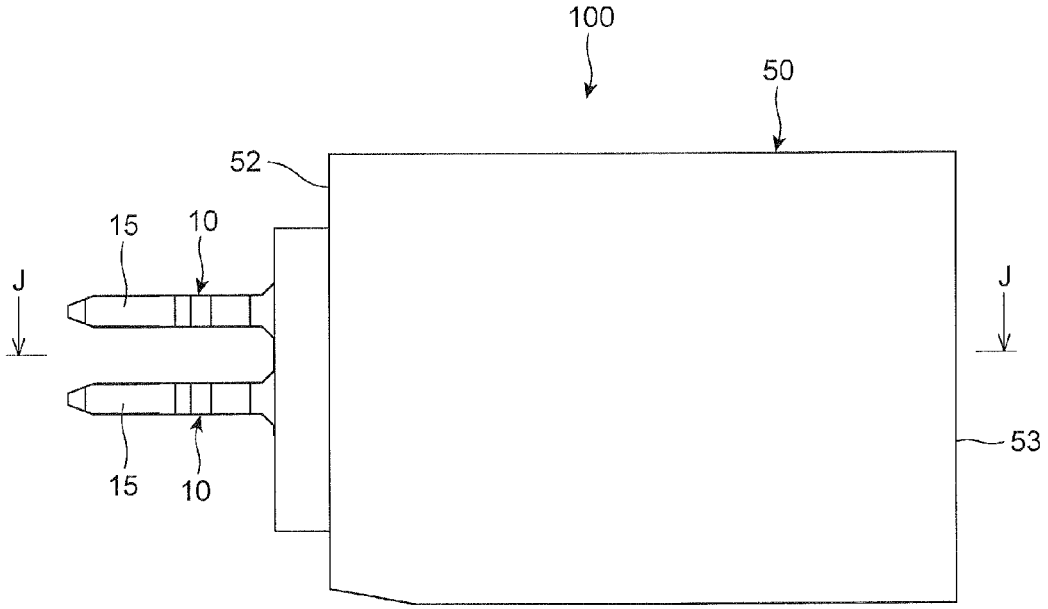
FIG. 10 is a bottom view of the electric connector, viewed in a direction of an arrow G shown in FIG. 7.
Figure 11:
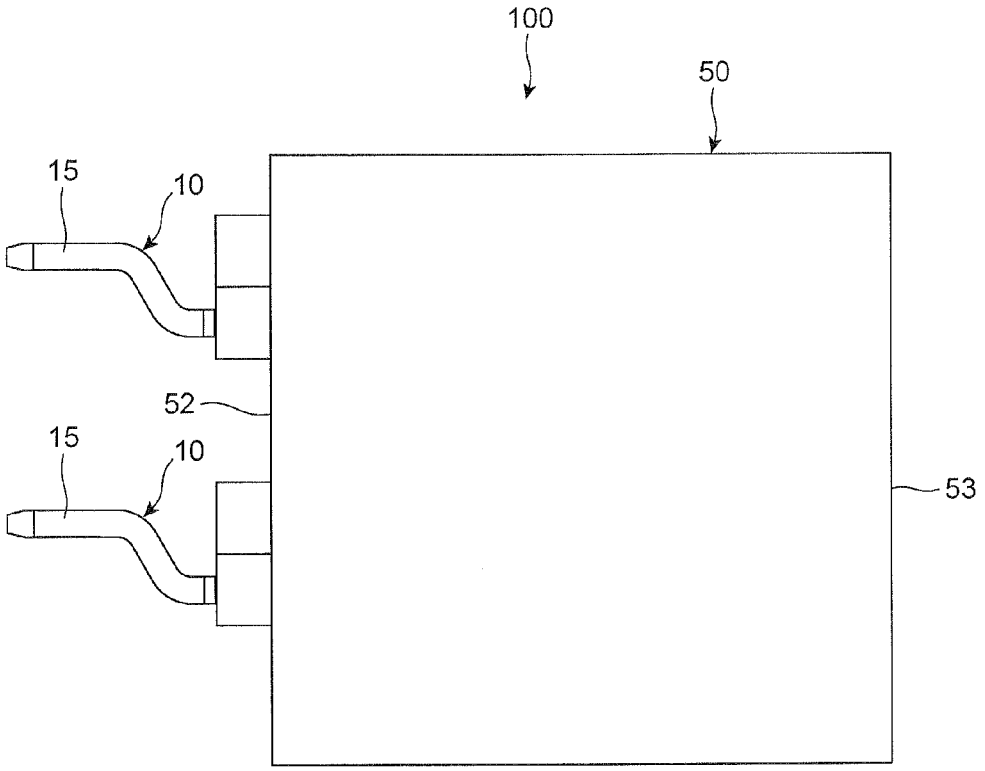
FIG. 11 is a side view of the electric connector, viewed in a direction of an arrow H shown in FIG. 7.
Figure 12:
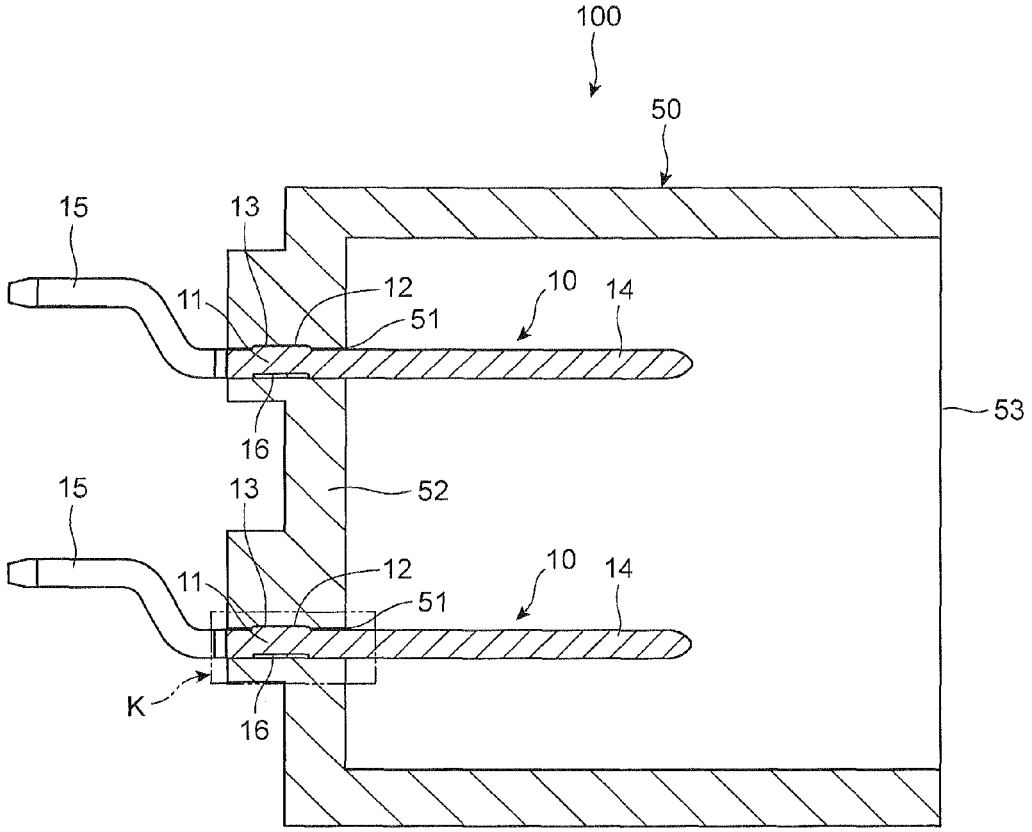
FIG. 12 is a cross-sectional view taken along the line J-J shown in FIG. 10.

As illustrated in FIGS. 6 and 7, the housing 50 is in the form of a box. The housing 50 has an opening 53 at an end and a bottom wall 52 at the other end. The bottom wall 52 is formed with through-holes 51 in the same number as that of the connector terminals 10.

As illustrated in FIGS. 7 to 11, the connector terminal 10 is an electrically conductive part to be fixed in the housing 50 by being inserted into the through-hole 51.

As illustrated in FIGS. 1 to 4, the connector terminal 10 includes a tab 14 in the form of a plate, and two terminals 15 outwardly extending from the tab 14.

Figure 1:
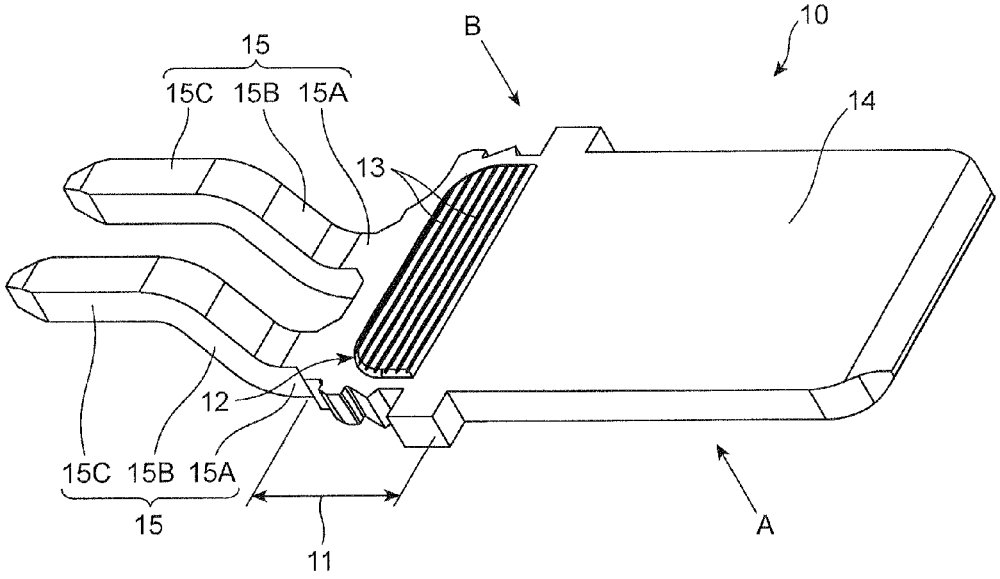
FIG. 1 is an upper perspective view of the connector terminal in accordance with the preferred embodiment of the present invention.
Figure 2:
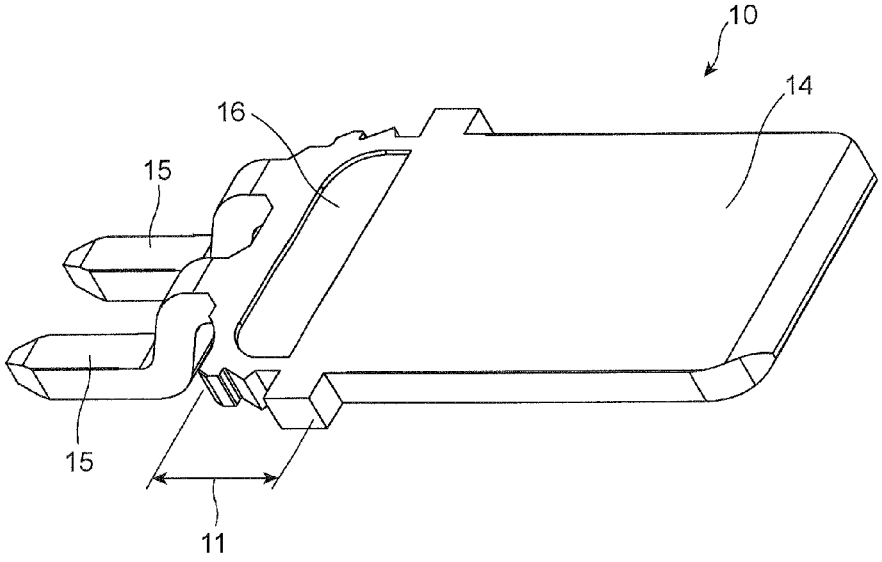
FIG. 2 is a perspective view of the connector terminal in accordance with the preferred embodiment of the present invention, viewed in a direction of an arrow A shown in FIG. 1.

The terminals 15 are spaced away from each other, and extend in parallel with each other. As illustrated in FIG. 1, each of the terminals 15 is comprised of a first part 15A straightly extending from the tab 14, a second part 15B obliquely extending from the first part 15A, and a third part 15C obliquely extending from the second part 15B such that the third part 15C is in parallel with a surface of the tab 14.

The tab 14 is inserted into a female connector terminal (not illustrated) of an electric connector to which the electric connector 10 is electrically connected. The terminals 15 are mechanically and electrically connected to a circuit board (not illustrated).

The connector terminal 10 includes, within the tab 14, a first portion 11 to be held in the through-hole 51, and a second portion 12 comprised of a raised area outwardly projecting from the first portion 11. The second portion 12 is formed with a plurality of grooves 13 extending in a direction perpendicular to a direction 10X (see FIG. 3) in which the connector terminal 10 is inserted into the through-hole 51 of the housing 50.

Figure 14:
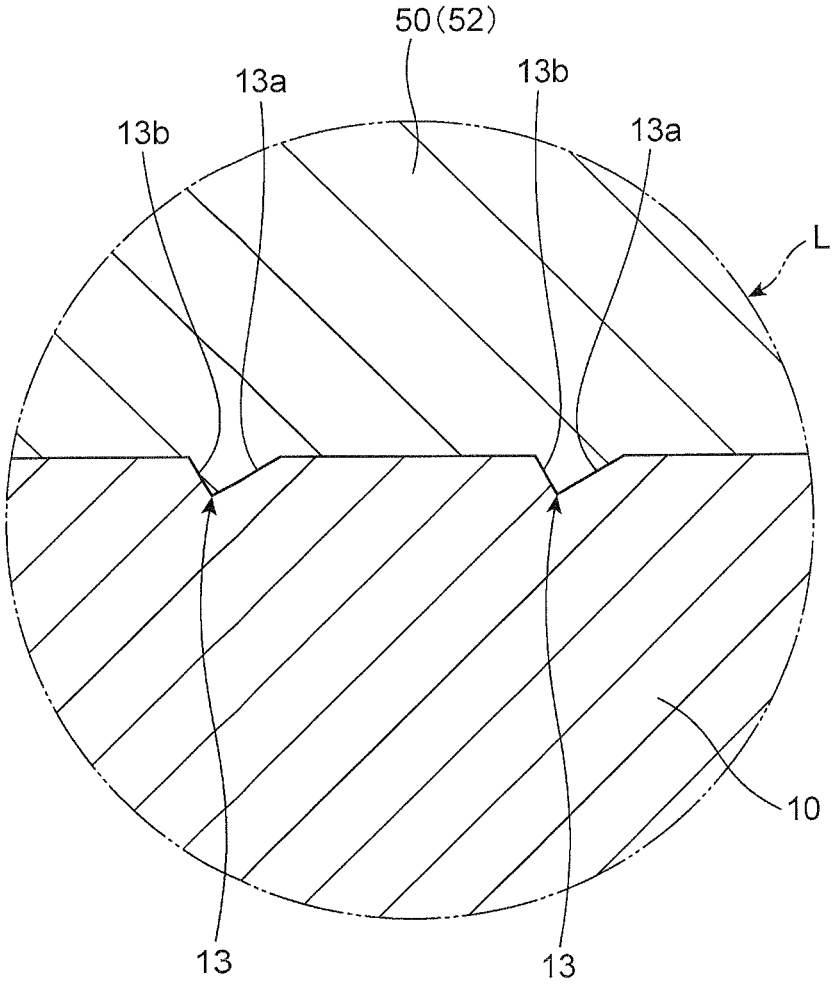
FIG. 14 is an enlarged cross-sectional view of the portion indicated with an arrow L shown in FIG. 13.
Figure 15:
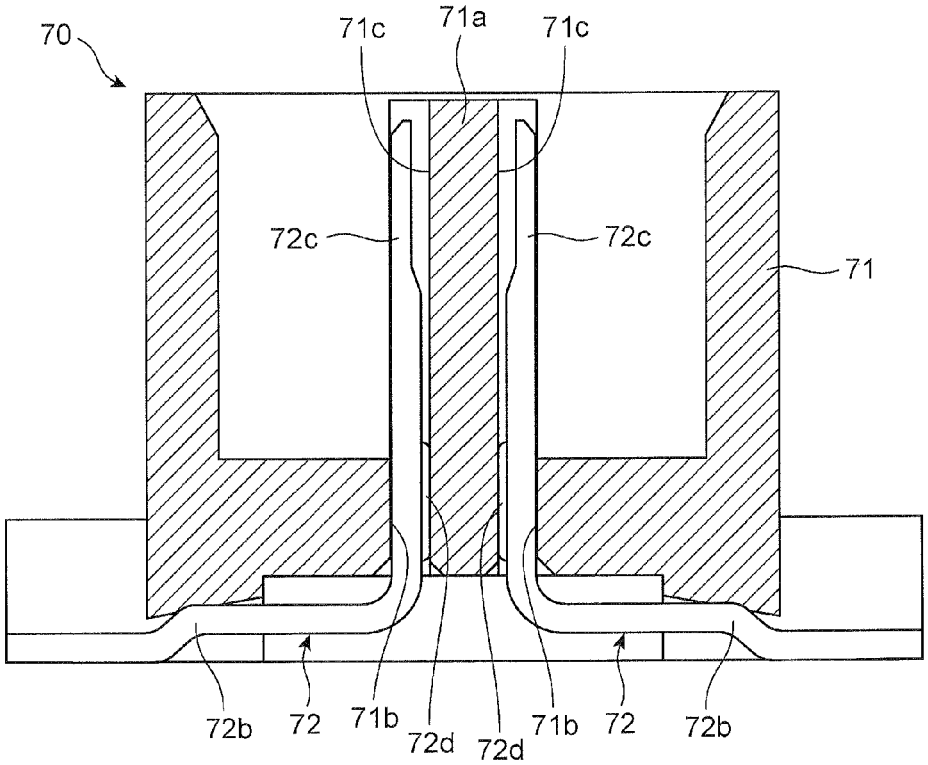
FIG. 15 is a cross-sectional view of the conventional plug connector.
Figure 16:
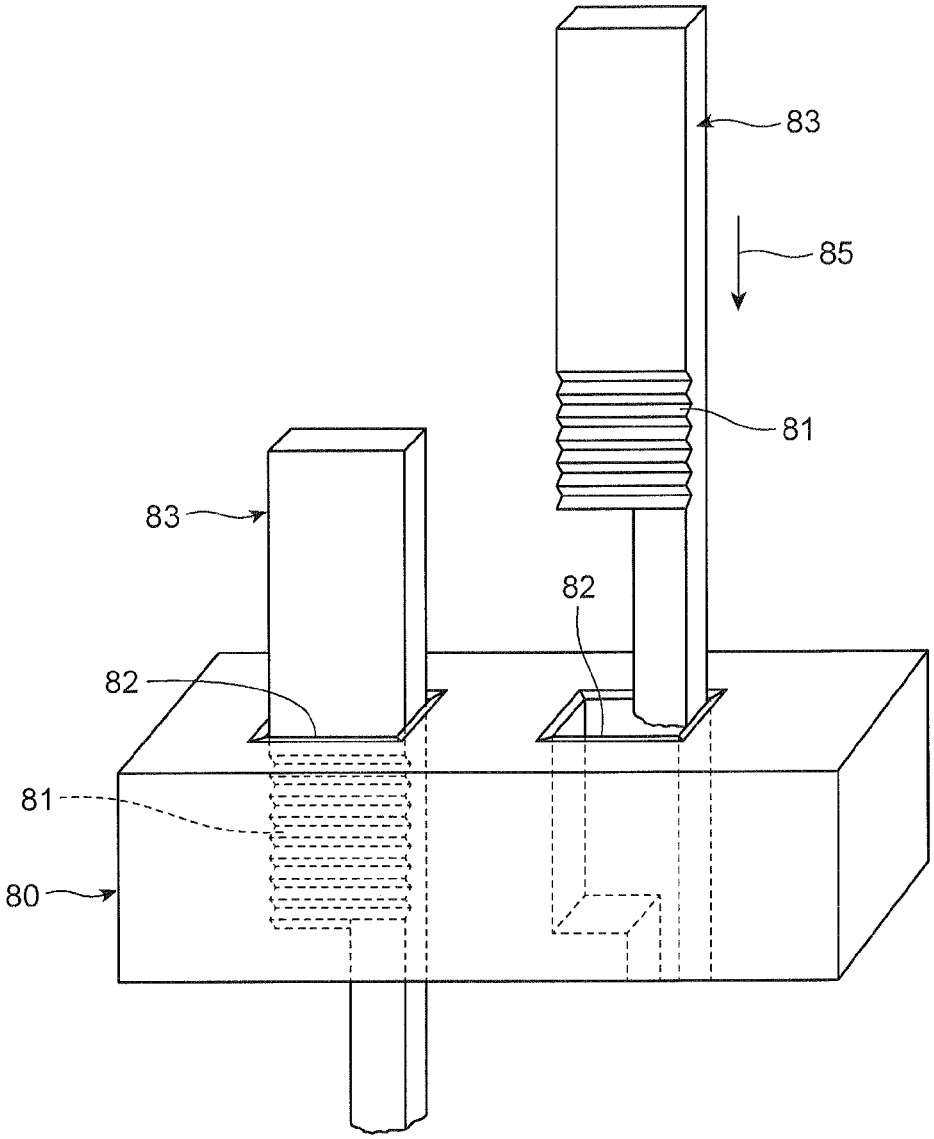
FIG. 16 is a perspective view of the conventional contact.
Figure 17:
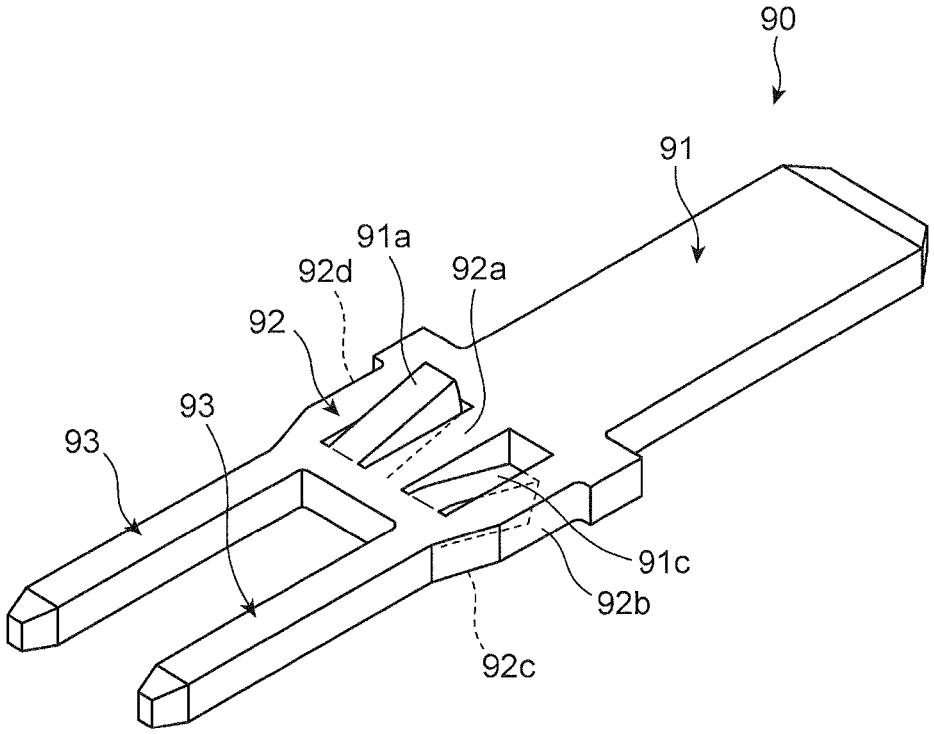
FIG. 17 is a perspective view of the conventional connector terminal.

As illustrated in FIG. 14, the groove 13 has a V-shaped cross-section. Supposing that the V-shaped groove 13 is defined with a first inclined surface 13*a* and a second inclined surface 13*b* located ahead of the first inclined surface 13*a* in the direction 10X (see FIG. 3), the first inclined surface 13*a* is designed to have an inclination angle smaller than the same of the second inclined surface 13*b*. Herein, an inclination angle is defined as an angle formed between the first/second inclined surfaces 13*a*, 13*b* and a horizontal line or a surface of the first portion 11.

Figure 3:
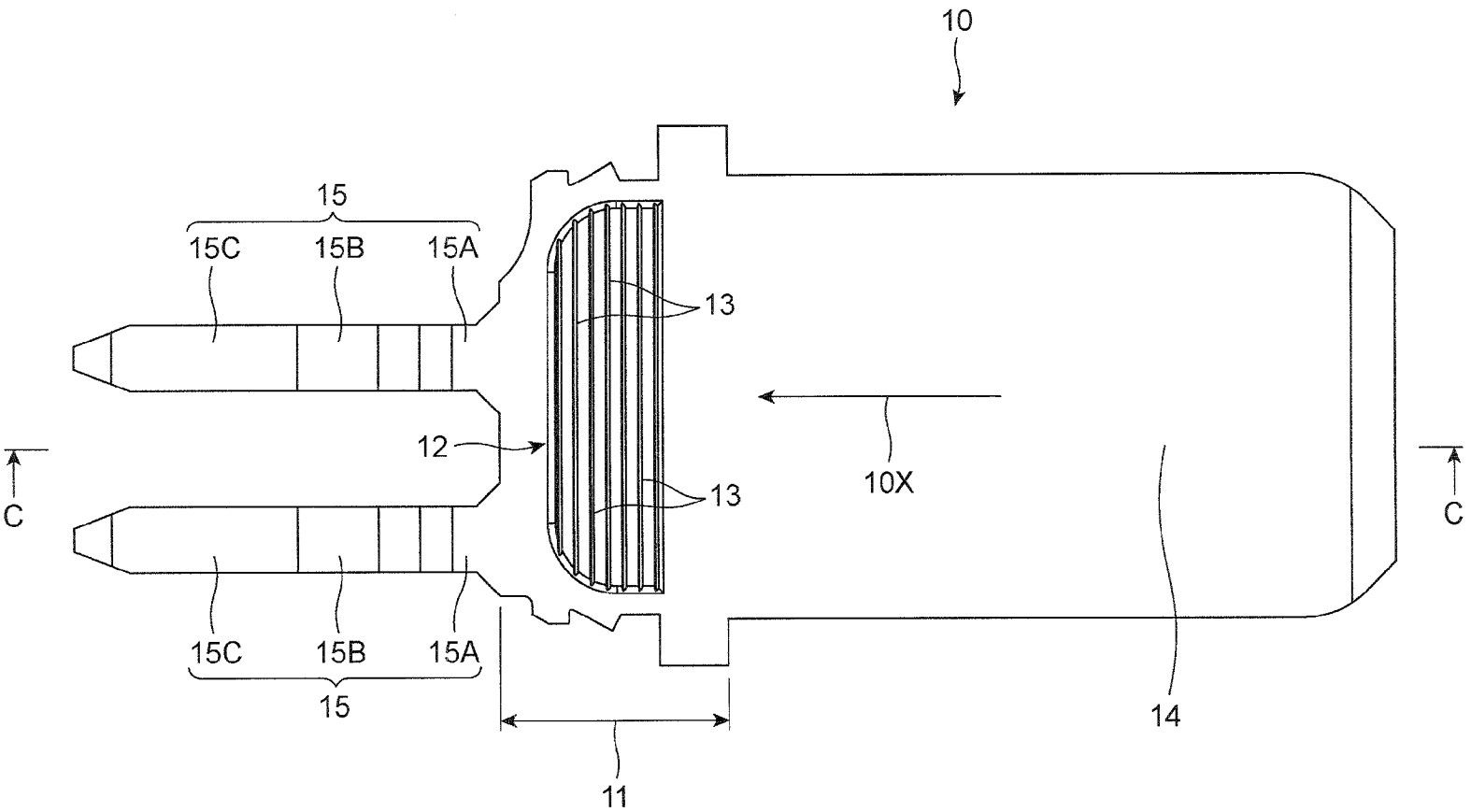
FIG. 3 is a plan view of the connector terminal in accordance with the preferred embodiment of the present invention, viewed in a direction of an arrow B shown in FIG. 1.
Figure 4:
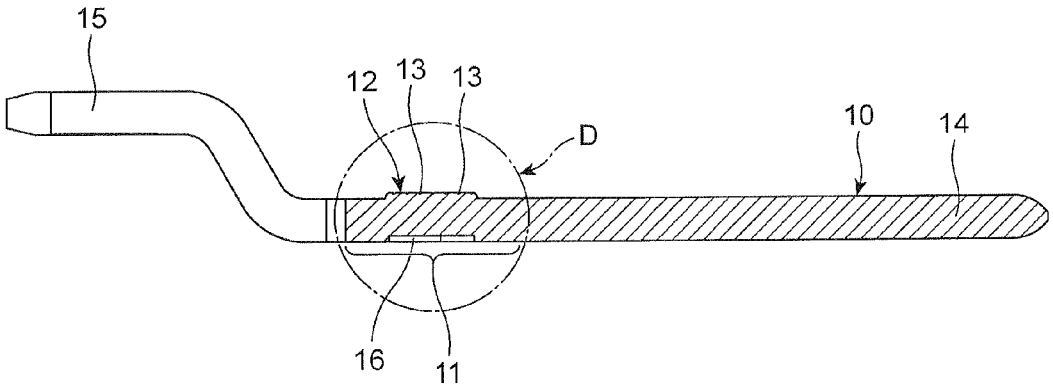
FIG. 4 is a cross-sectional view taken along the line C-C shown in FIG. 3.

As illustrated in FIG. 3, the grooves 13 each extending perpendicularly to the direction 10X are arranged in the direction 10X. That is, the grooves 13 are located adjacent to one another in the direction 10X.

A process of fabricating the second portion 12 and the grooves 13 is explained hereinbelow with reference to FIGS. 4 and 5A to 5C.

Figure 5A:
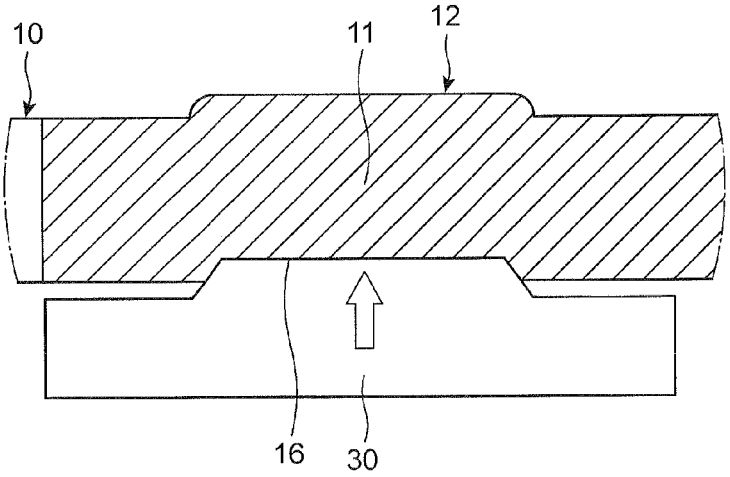
FIG. 5A is a cross-sectional view showing a process of fabricating the portion D shown in FIG. 4.

As illustrated in FIG. 5A, the tab 14 is pressed within an area of the first portion 11 by means of a die 30 towards an upper surface from a lower surface of the first portion 11. Thus, the second portion 12 projecting towards an upper surface from a lower surface of the first portion 11 is formed on an upper surface of the first portion 11. Concurrently, there is formed a recess on a lower surface of the first portion 11. The recess 16 is similar in shape to the second portion 12. The second portion 12 has a flat upper surface, and is rounded at a circumference. The recess 16 is recessed towards an upper surface from a lower surface of the first portion 11.

Figure 5B:
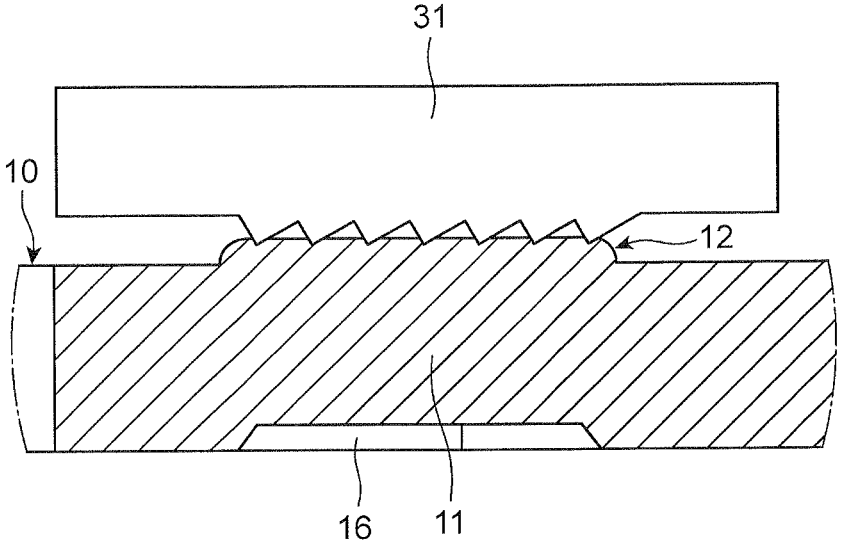
FIG. 5B is a cross-sectional view showing a process of fabricating the portion D shown in FIG. 4.

Then, as illustrated in FIG. 5B, after the die 30 was released from the first portion 11, the second portion 12 is pressed at an upper surface thereof by means of a die 31 having a saw-blade cross-section.

Figure 5C:
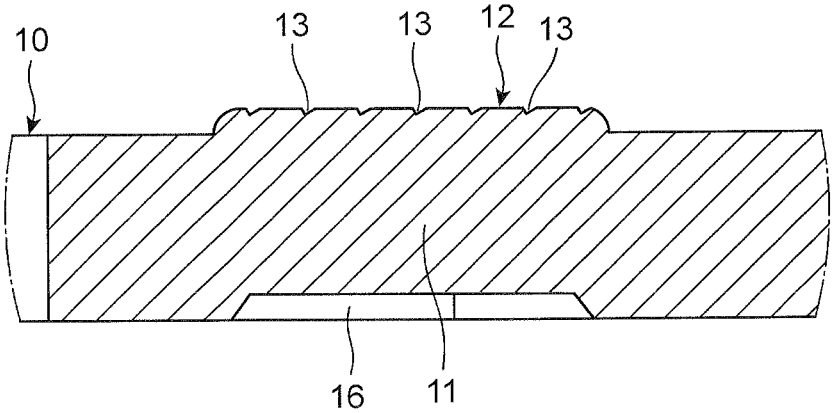
FIG. 5C is a cross-sectional view showing a process of fabricating the portion D shown in FIG. 4.

Thus, as illustrated in FIG. 5C, the second portion 12 is formed at a surface thereof with a plurality of the grooves 13 each having a V-shaped cross-section. Thus, there is fabricated the connector terminal 10 as illustrated in FIGS. 1 to 4.

In the connector terminal 10 in accordance with the preferred embodiment, the grooves 13 are formed on an entire surface of the second portion 12. It should be noted that the grooves 13 may be formed on a part of a surface of the second portion 12.

Then, as illustrated in FIG. 6, the connector terminals 10 are inserted into the housing 50 through the opening 53 towards the bottom such that the terminals 15 are directed to the through-holes 51, and then, the first portion 11 of each of the connector terminals 10 is inserted into the through-hole 51. As illustrated in FIGS. 7 to 12, the first portion 11 is fixedly held in the through-hole 51. Thus, there is completed the electric connector 100.

As mentioned before, the connector terminal 10 includes the second portion 12 projecting from a lower surface 11*b* toward an upper surface 11*a* of the first portion 11, and a plurality of the grooves 13 formed on a surface of the second portion 12 and each extending in a direction perpendicular to the direction 10X.

Figure 13:
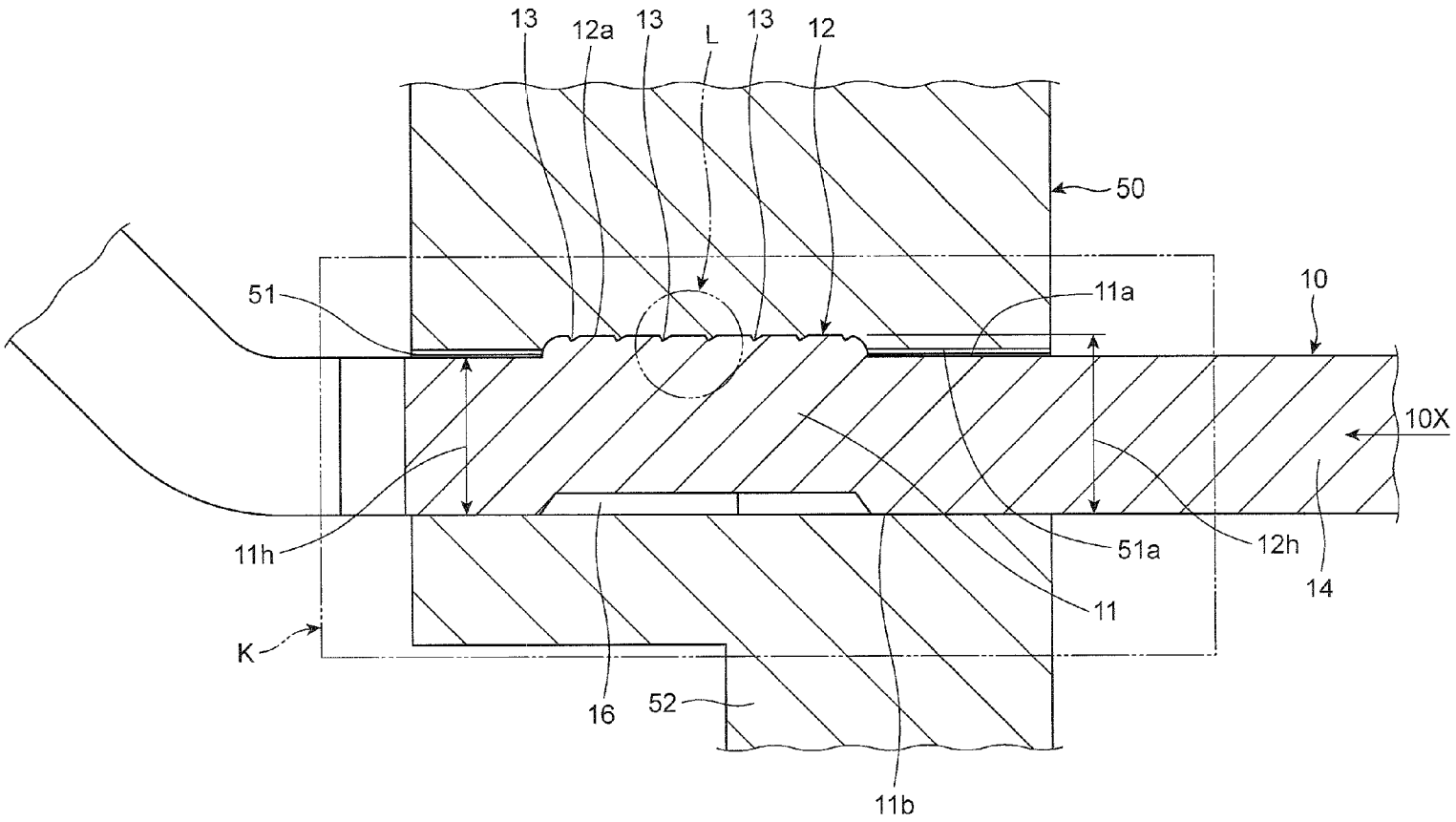
FIG. 13 is an enlarged cross-sectional view of the portion indicated with an arrow K shown in FIG. 12.

Thus, as illustrated in FIG. 13, a distance 12*h* between the lower surface 11*b* of the first portion 11 and a surface 12*a* of the second portion 12 is greater than a distance 11*h* between the lower surface 11*b* and the upper surface 11*a* of the first portion 11. Accordingly, when the first portion 11 of the connector terminal 11 is inserted into the through-hole 51 of the housing 50, the second portion 12 upwardly projecting beyond the upper surface 11*a* of the first portion 11 makes close abutment with an inner surface 51*a* of the through-hole 51, and hence, the first portion 11 is fixedly held in the through-hole 51, ensuring that an accuracy with which the connector terminal 10 is situated relative to the housing 50 can be increased.

Furthermore, as illustrated in FIG. 14, when the first portion 11 is inserted into the through-hole 51 of the housing 50, elastically insulating resin of which the inner surface 51*a* of the through-hole 51 is made thrusts, by virtue of a frictional force generated between the second portion 12 and the inner surface 51*a* of the through-hole 51, into the grooves 13 formed on the surface 12*a* of the second portion 12, ensuring that the connector terminal 10 is kept held in the through-hole 51 with an intensive force.

Since each of the grooves 13 is designed to have a V-shaped cross-section, a force with which the connector terminal 10 is kept held in the through-hole 51 can be further increased.

As illustrated in FIG. 14, the first inclined surface 13*a* is designed to have an inclination angle smaller than the same of the second inclined surface 13*b*. Thus, the above-mentioned force can be increased without increasing a force with which the first portion 11 is inserted into the through-hole 51 of the housing 50. Since the grooves 13 are arranged in the direction 10X (see FIG. 3), electrically insulating resin of which the inner surface 51*a* of the through-hole 50 is made thrusts into the grooves 13, and thus, is firmly engaged to the inner surface 51*a* of the through-hole 50, a force with which the connector terminal 10 is kept held in the through-hole 51 can be further increased.

The connector terminal 10 in accordance with the preferred embodiment is designed to include the tab 14 and the terminals 15, as illustrated in FIGS. 1 to 4. It should be noted that the connector terminal 10 may be designed to have any parts, if the connector terminal 10 is designed to include the first portion 11 and the second portion 12 formed on the surface 12 thereof with the grooves 13 as indispensable parts.

INDUSTRIAL APPLICABILITY

The connector terminal in accordance with the present invention can be used broadly in various fields such as an automobile field, as a part of an electric connector to be equipped in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-220332 filed on Oct. 23, 2013 including specification, claims, drawings and summary is incorporated herein by reference in its entirety.

What is claimed is:

1. An electric connector including:

a housing formed with an opening; and a connector terminal to be inserted into and held in said opening of said housing, said connector terminal, including:

a tab in the form of a plate; and at least one terminal portion extending from said tab, said tab including:

a first portion inserted into said opening such that said first portion is held in said opening; and a second portion outwardly projecting from one surface of said first portion, said second portion being formed at a surface thereof with at least one groove extending perpendicularly to a direction in which said connector terminal is inserted into said opening, said first portion being formed at another surface thereof with a recess having an outline analogous to the same of said second portion, said second portion having a height such that said second portion makes close contact with an inner surface of said opening of said housing, said terminal portion outwardly extending from said housing through said opening when said connector terminal is inserted into said opening.

2. The electric connector as set forth in claim 1, wherein said second portion is formed by pressing said first portion from said other surface to said one of surfaces.

3. The electric connector as set forth in claim 1, wherein said groove is V-shaped.

4. The electric connector as set forth in claim 3, wherein said V-shaped groove is defined with a first inclined surface and a second inclined surface located ahead of said first inclined surface in said direction, said first inclined surface having an inclination angle smaller than the same of said second inclined surface, said inclination angle being defined as an angle formed between said first or second inclined surface and a surface of said first portion.

5. The electric connector as set forth in claim 1, wherein said second portion is formed at a surface thereof with a plurality of grooves extending perpendicularly to said direction, said grooves being arranged in said direction.

6. The electric connector as set forth in claim 5, wherein said second portion is formed at an entire surface thereof with said grooves.

* * * * *